US005913339A

United States Patent [19]

Lee

[11] Patent Number: 5,913,339

[45] Date of Patent: Jun. 22, 1999

[54] PAPERMAKER'S FABRIC SEAM WITH IMPROVED LOOP ALIGNMENT

[75] Inventor: Henry J. Lee, Summerville, S.C.

[73] Assignee: Asten, Inc., Charleston, S.C.

[21] Appl. No.: 08/940,770

[22] Filed: Sep. 30, 1997

[51] Int. Cl.[6] ..... D03D 13/00

[52] U.S. Cl. ..... 139/383 AA; 442/270; 428/193; 428/58

[58] Field of Search ..... 139/383 AA; 442/270; 428/193, 58

[56] References Cited

U.S. PATENT DOCUMENTS

| | | | |
|---|---|---|---|
| 3,815,645 | 6/1974 | Codorniu | 139/383 A |
| 4,182,381 | 1/1980 | Gisbourne | 139/383 AA |
| 4,438,789 | 3/1984 | MacBean . | |
| 4,824,525 | 4/1989 | Penven | 139/383 AA |
| 4,896,702 | 1/1990 | Crook | 139/383 A |
| 4,979,543 | 12/1990 | Moriarity et al. | 139/383 AA |
| 5,188,884 | 2/1993 | Smith | 139/383 AA |
| 5,476,123 | 12/1995 | Rydin | 139/383 A |
| 5,779,709 | 9/1998 | Shipley | 139/383 AA |

FOREIGN PATENT DOCUMENTS 0341041 11/1989 European Pat. Off. .

*Primary Examiner*—Andy Falik
*Attorney, Agent, or Firm*—Volpe and Koenig, P.C.

[57] ABSTRACT

An open ended papermaker's fabric having first and second layers of machine direction (MD) yarns interwoven with a plurality of cross machine direction (CMD) yarns. Additional CMD yarns are interwoven with both MD layers at each end of the fabric between the last CMD yarn and the seam loops in a balancing weave that establishes vertical and horizontal alignment for the seam loops.

8 Claims, 9 Drawing Sheets

PAPERMAKER'S FABRIC SEAM WITH IMPROVED LOOP ALIGNMENT

BACKGROUND OF THE INVENTION

1. Field of the Invention

The present invention generally relates to a woven fabric which is rendered endless by interdigitating a plurality of loops which are on the two ends of the fabric.

2. Description of the Prior Art

As will be known to those skilled in the art, papermaking machines generally include three sections which generally are referred to as the formation, press and dryer sections. Papermaking fabrics are used to transport the paper product through the various sections of the papermaking equipment. Many papermaking fabrics are woven fabrics comprising a system of warp yarns interwoven with a system of weft yarns.

The woven fabric may be woven as an endless loop and utilized as such so there is no seam. Alternatively, the fabric may be woven to have two ends which are joined at a seam to form the endless loop. Various seams are known in the art, including pin type seams which utilize a joining wire or pintle which is inserted through seam loops at each end of the fabric to render it endless.

One technique of forming a fabric having seam loops is to provide an endless weave wherein loops are formed by weaving stacked weft yarns around a forming wire. U.S. Pat. No. 3,815,645 provides an example of such a weaving technique. A common problem associated with this type of loop formation is non-uniform loop alignment, both in the vertical and horizontal axis, when the forming wire is removed. This misalignment creates seaming loops that are difficult to intermesh on the papermaking machine.

FIGS. 1–3 show representative loop misalignments experienced in common prior art endless woven seams. Generally, as a loom weaves the loops in an endless weave, it naturally offsets the returning weft position slightly from its outgoing weft position. Therefore, it is necessary to maintain the weft yarns in a stacked relationship throughout the fabric through the balanced weave of the warp yarns. The last warp yarn 2, however, is generally not balanced by adjacent yarns on each side and therefore, an unbalanced crimp force is applied to the weft yarns in the loop area, as shown by the arrows in FIG. 2. As a result, the two weft yarn passes which form each loop are not balanced by warps and the loops tend to be misaligned.

A similar misalignment of the loops occurs in flat woven fabrics wherein the tie back portion of the warp yarn is offset from the outgoing portion of the warp yarn during loop formation.

In the present invention, additional cross machine direction (CMD) end yarns are woven in a balanced weave to reduce the unbalanced crimp force acting on each of the seam loops. Thus, the loops are held in better horizontal and vertical alignment.

SUMMARY OF THE INVENTION

The present invention provides an open ended papermaker's fabric having first and second layers of machine direction (MD) yarns interwoven with a plurality of cross machine direction (CMD) yarns in a first weave pattern that forms a plurality of seam loops at each end of the fabric. At least one additional CMD yarn is interwoven with both MD layers at each end of the fabric between the last CMD yarn and the seam loops in a second, balancing weave that establishes vertical and horizontal alignment for the seam loops.

DESCRIPTION OF THE PREFERRED EMBODIMENTS

Figure 1:
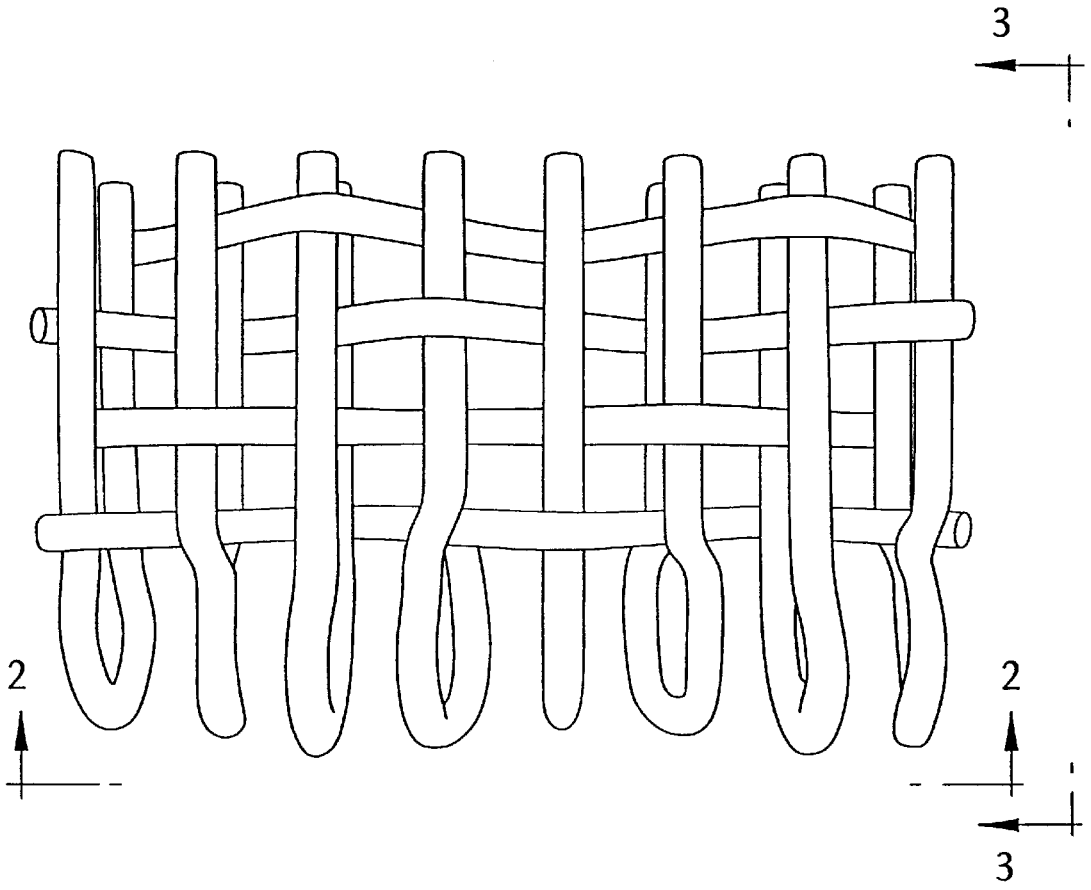
FIG. 1 (PRIOR ART)
FIG. 1 is a top plan view of prior art end loops.
Figure 2:
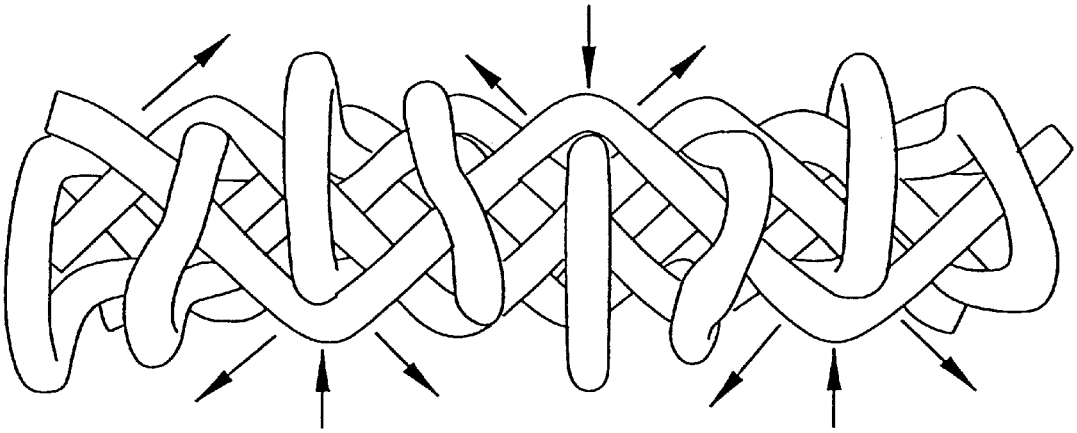
FIG. 2 (PRIOR ART)
FIG. 2 is an elevation view of the prior art end loops along the line 2—2 in FIG. 1.
Figure 3:
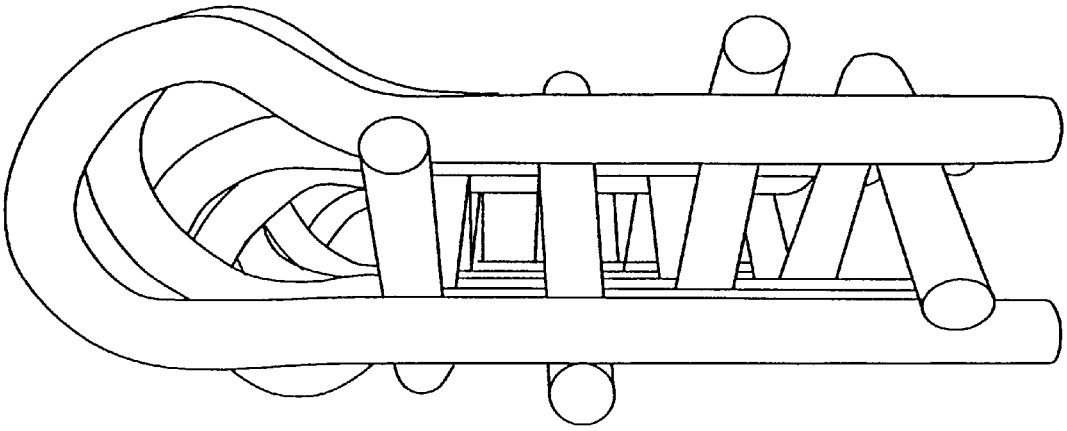
FIG. 3 (PRIOR ART)
FIG. 3 is a side elevation view of the prior art end loops along the line 3—3 in FIG. 1.

The preferred embodiments will be described with reference to the drawing figures where like numerals represent like elements throughout.

Figure 4:
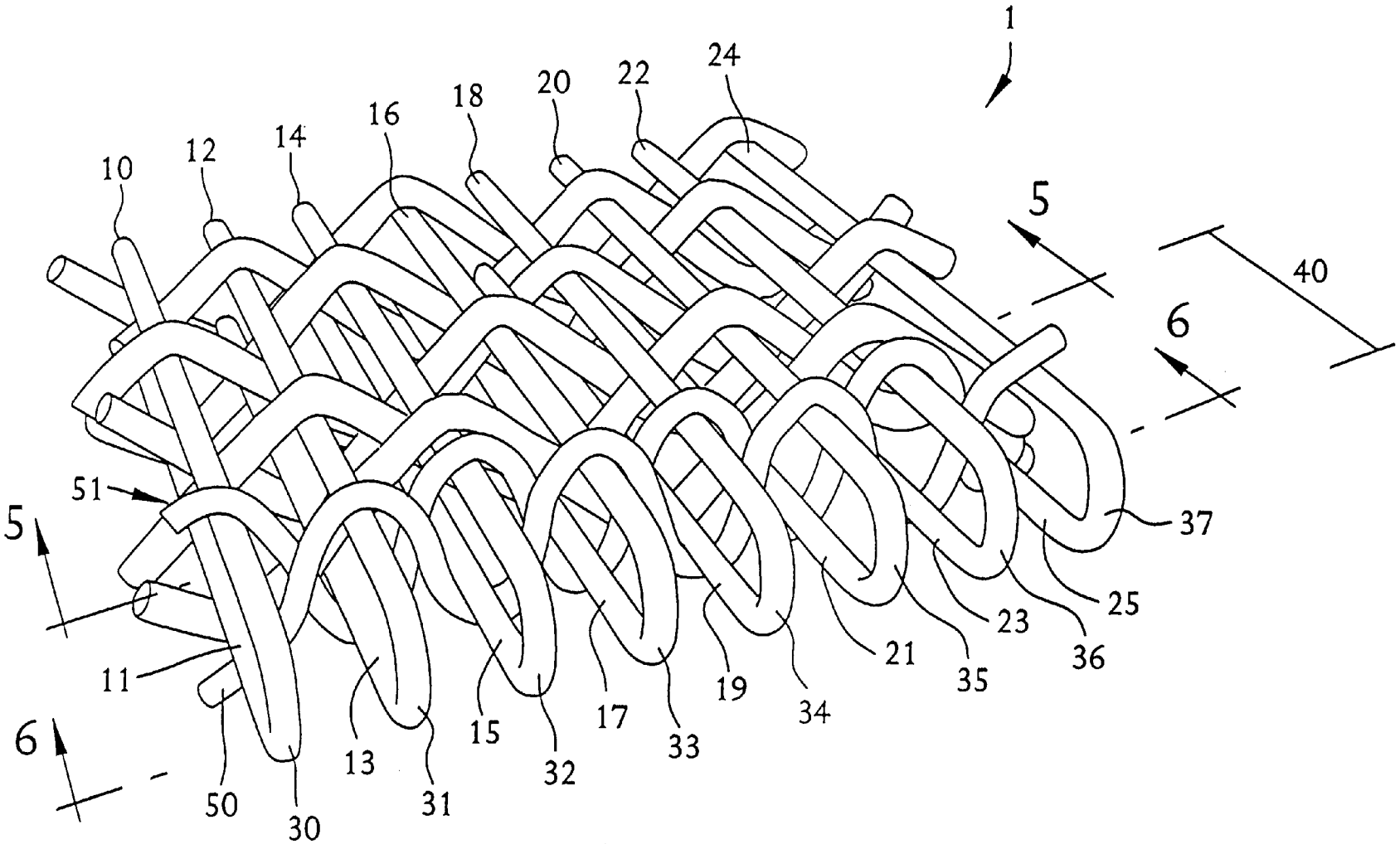
FIG. 4 is a perspective view of a portion of the fabric according to the present invention.
Figure 5:
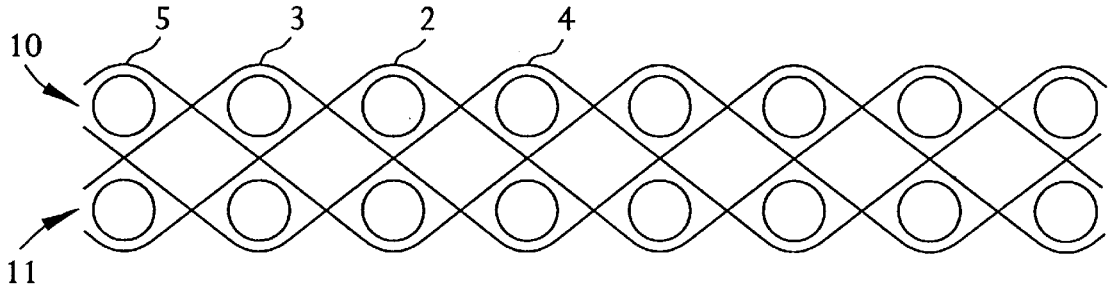
FIG. 5 is a section view of the fabric along the line 5—5 in FIG. 4.
Figure 6:
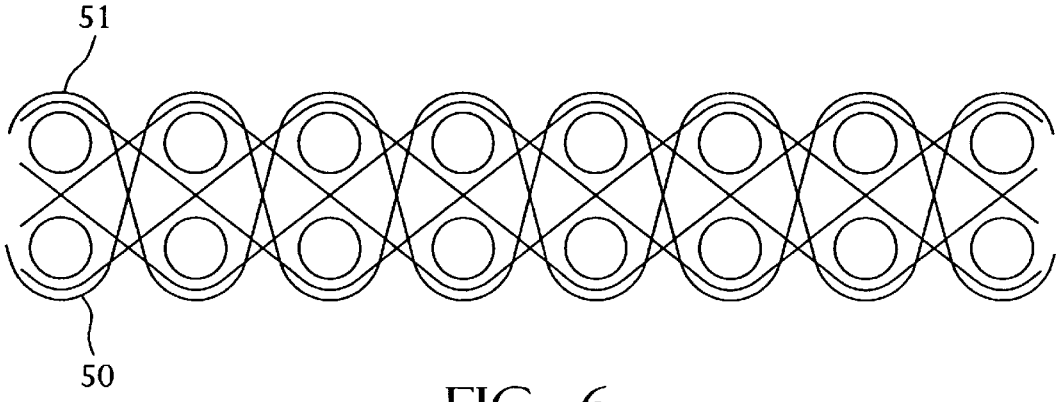
FIG. 6 is a section view of the fabric along the line 6—6 in FIG. 4.

Referring to FIG. 4, a portion of a papermaking fabric 1 made in accordance with the present invention is shown. The papermaking fabric 1 comprises a MD top layer 10 and a MD bottom layer 11. CMD yarns 2–5 are interwoven with the top and bottom yarn layers 10, 11 which are joined at each end of the fabric 1 by seam loops 30–37, respectively. The seam loop zone 40 is formed at each end of the fabric 1. In the preferred endless woven embodiment, the CMD yarns 2–5 are warp yarns woven in a repeat pattern that passes over, between, under, between the two layers of MD or weft yarns 10, 11, as shown in FIG. 5.

As explained above, the last CMD yarn 2 generally causes non-uniform, unbalanced forces on the seam loops 30–37. To reduce the unbalanced forces, two additional CMD yarns 50, 51 are woven with both layers of MD yarns 10, 11 in each seam loop zone 40 in a balancing weave. In the preferred embodiment, the additional CMD yarns 50, 51 are woven in a single repeat of plain weave.

Figure 7:
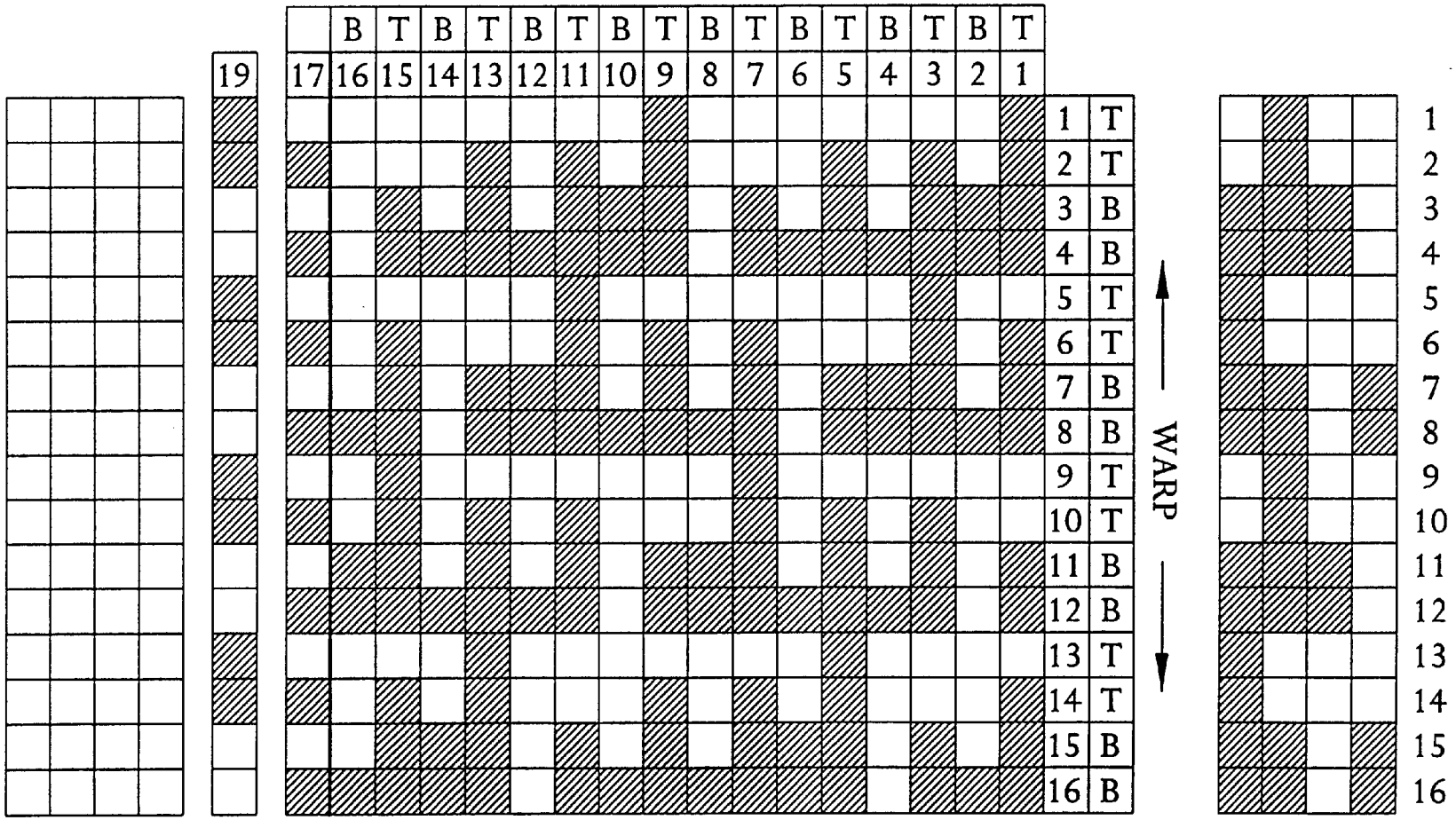
FIG. 7 is a weave pattern diagram of the fabric of FIGS. 4–6.
Figure 8:
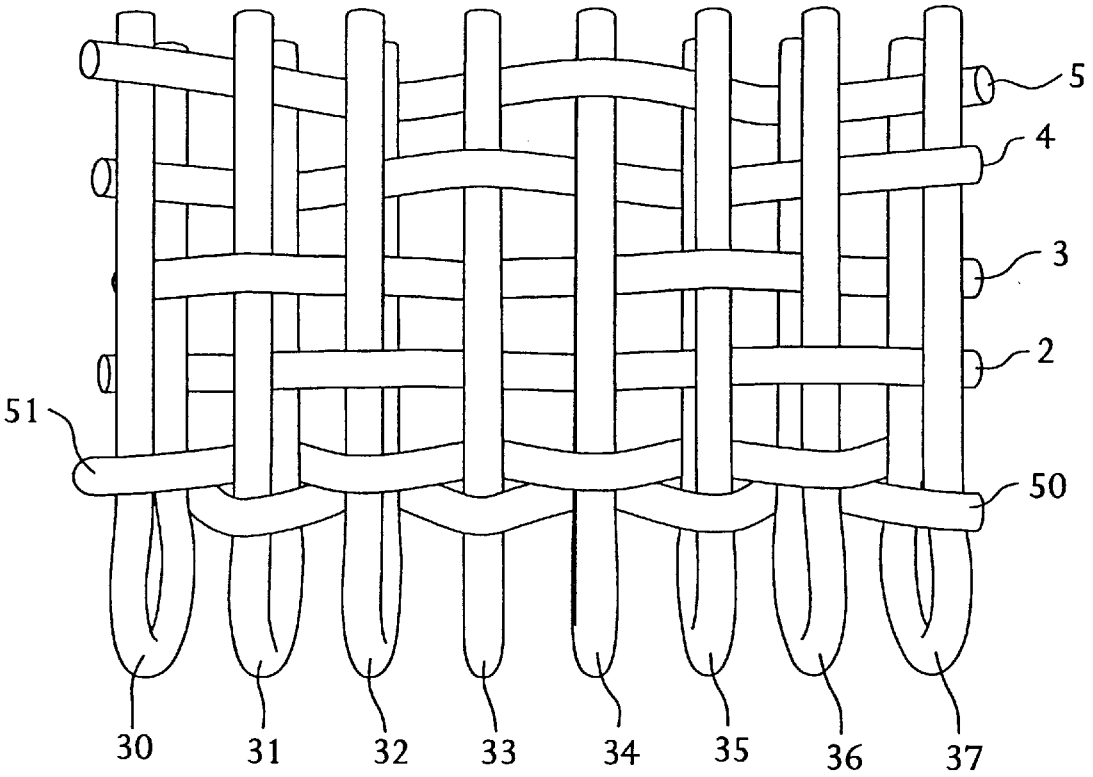
FIG. 8 is a top plan view of a portion of one end of the fabric.
Figure 9:
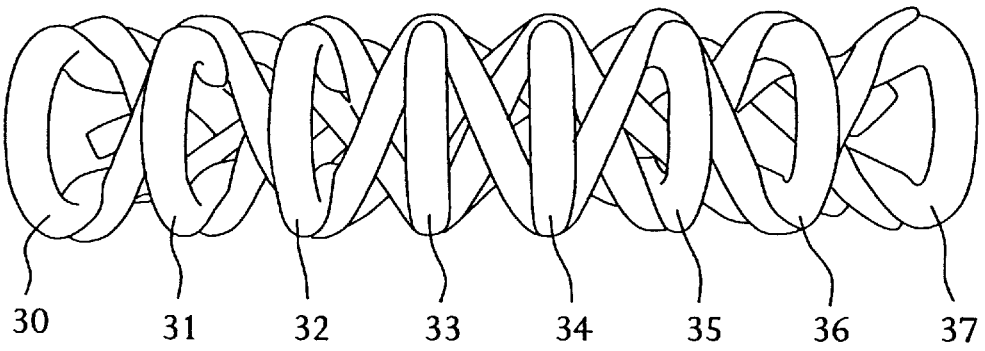
FIG. 9 is a front elevation of a portion of one end of the fabric.
Figure 10:
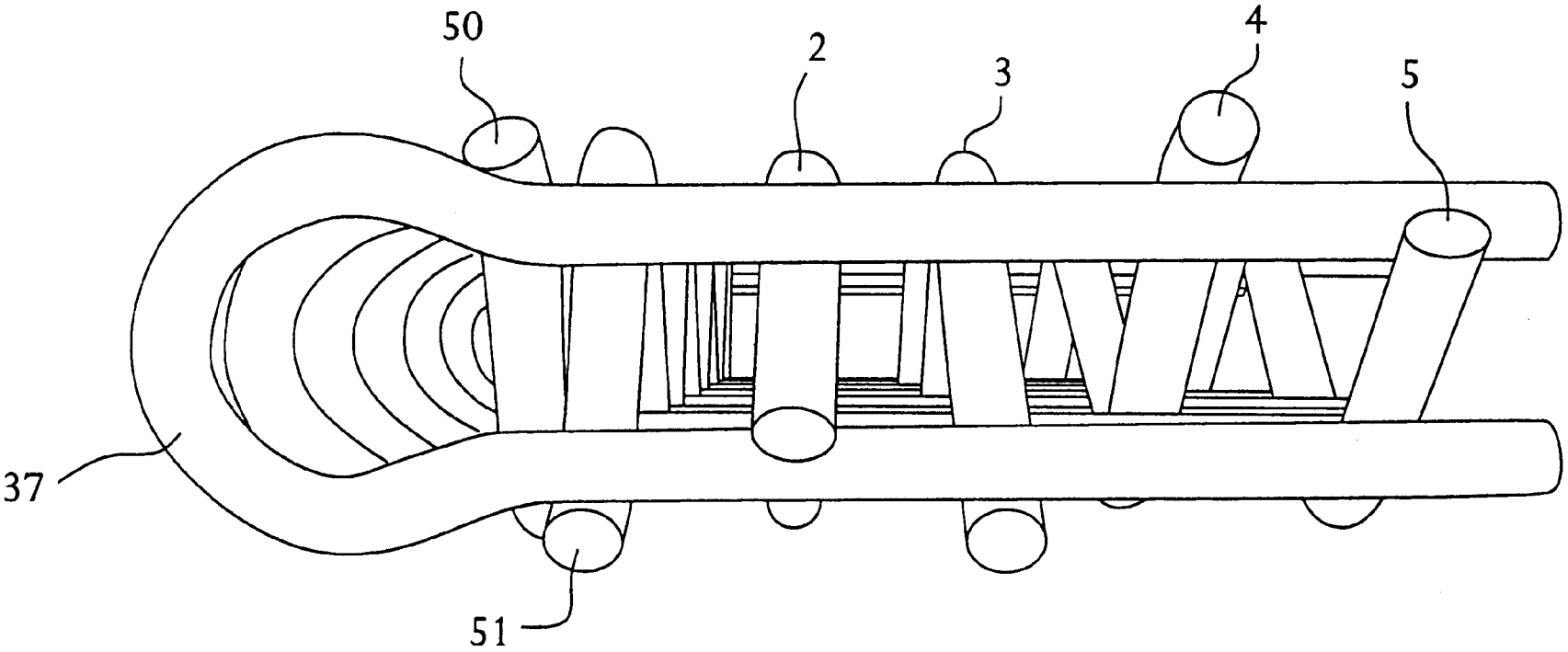
FIG. 10 is a side elevation of a portion of one end of the fabric.
Figure 11:
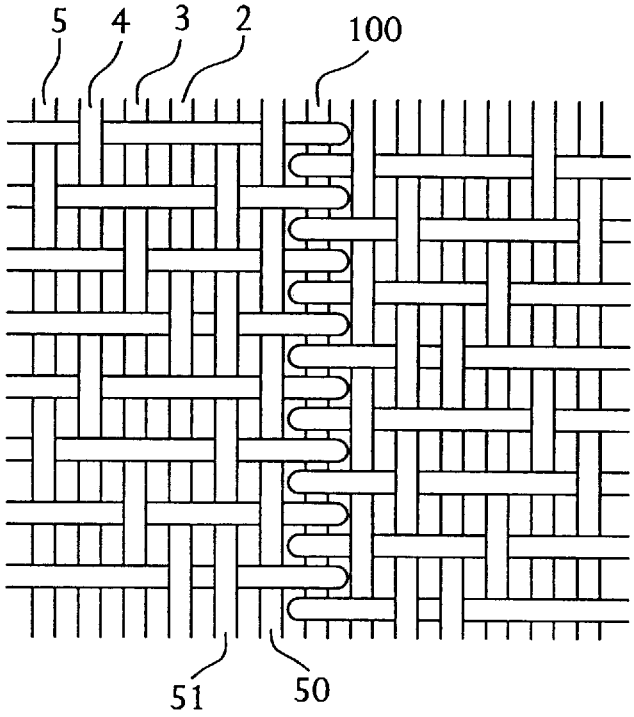
FIG. 11 is a top plan view of a portion of both ends of the fabric seamed together.

As shown in FIG. 7, in such a plain weave, additional CMD yarn 50 weaves over and under the two MD layers 10, 11 in a given repeat while additional CMD yarn 51 weaves under and over the MD yarn layers 10, 11 of the same repeat. As a result, the crimp force of the additional CMD yarns 50 and 51 counter balance the crimp force of the fabric body CMD yarns 2–5 on the loops 30–37 across the width of the fabric 1. Consequently, the seam loops 30–37 are held in better vertical and horizontal alignment as shown in FIGS. 8–10. This allows for more efficient interdigitating of the loops 30–37 and easier insertion of the pintle 100, as shown in FIG. 11.

Figure 12:
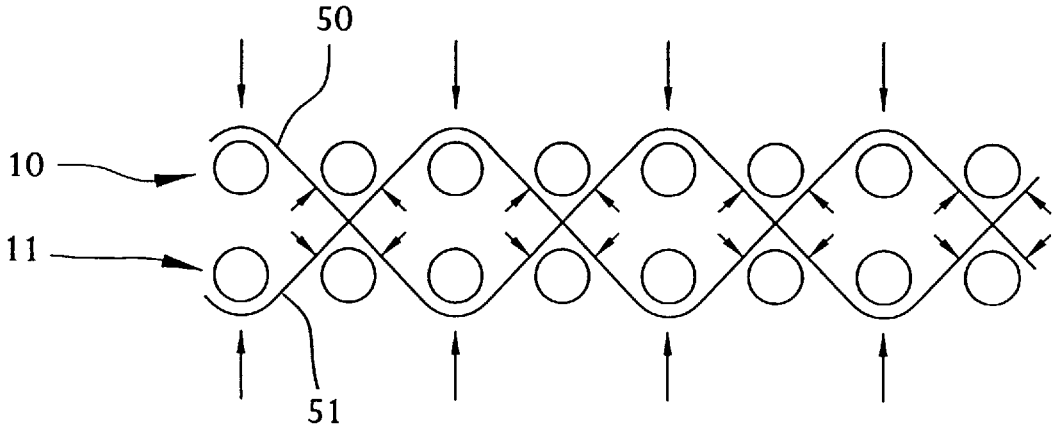
FIG. 12 is an elevation view showing the weave pattern of the balancing yarns of an alternate embodiment.

An alternate balancing weave pattern for the additional CMD yarns 50, 51 is shown in FIG. 12. The additional CMD yarns 50,51 weave in opposing "N" weaves wherein additional CMD yarn 50 weaves over, between, under and between the two MD layers in a given repeat, while additional CMD yarn 51 weaves under, between, over and between the same MD yarns. As shown by the arrows in FIG. 12, the resulting crimp forces of the additional yarns 50, 51 balance the weave and thereby provide greater balance to the MD yarns and the loops formed thereby.

If desired, batting material 110 may be attached to one or both sides of the fabric 1. In such event, the additional CMD yarns 50, 51 furnish an additional benefit of providing additional anchoring points for the batt material 110 in the seam loop zone 40. In both of the above embodiments, the additional CMD yarns 50, 51 are preferably multifilament yarns which tend to be more receptive to needling and provide greater batt anchorage in the seam loop zone 40.

Figure 13:
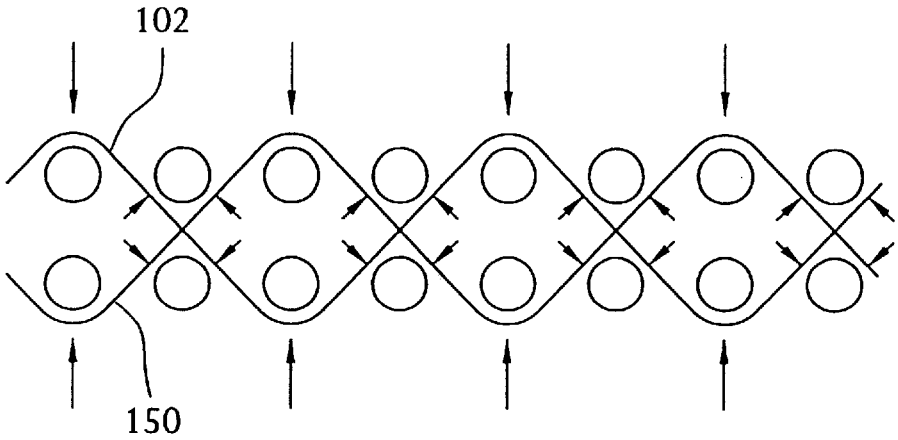
FIG. 13 is an elevation view showing the weave pattern of an alternate embodiment of the invention.
Figure 14:
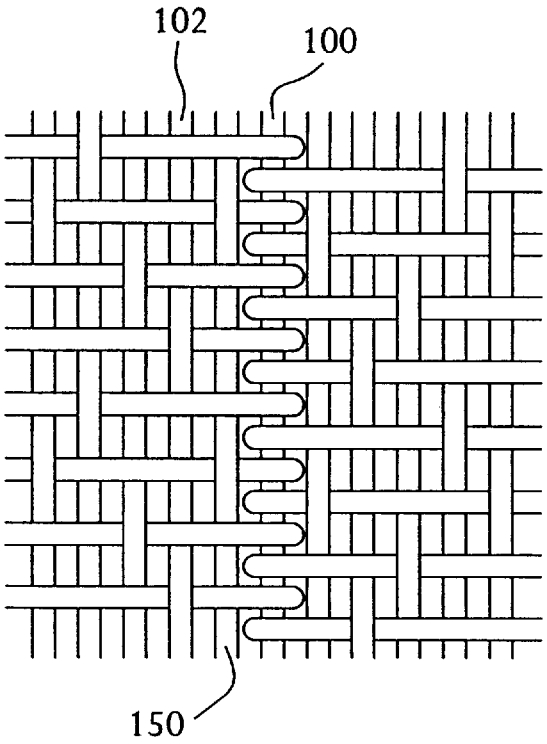
FIG. 14 is a top view of two ends of the fabric of FIG. 13 seamed together.

In applications where the batt material 110 is anchored in a different manner or batt anchorage is less crucial, it may be beneficial to use an additional yarn which has the same characteristics of the last CMD yarn 102. In such an embodiment, only one additional yarn 150, as shown in FIGS. 13–14, may be required since it is able to apply counter balancing forces to the last CMD yarn 102 directly. The additional CMD yarn 150 is woven in a repeat which is inverse to that of the last CMD yarn 102. That is, if the last CMD yarn 102 weaves over, between, under and between pairs of MD yarns in a given repeat, the additional CMD yarn 150 weaves under, between, over and between in the same repeat. As a result, the additional CMD yarn 150 counter balances the crimp forces of the last CMD yarn 102, as shown in FIG. 13.

While the present invention has been described in terms of the preferred embodiments, other variations which are within the scope of the invention as outlined in the claims will be apparent to those skilled in the art.

I claim:

1. An open ended papermaker's fabric of a type having a MD yarn system, including adjacent pairs of upper and lower MD yarns, interwoven with a CMD yarn system wherein a plurality of seam loops are formed at each end of the fabric by yarns from the MD yarn system and a seam zone is defined at each end of the fabric between the respective seam loops and a respective last CMD yarn, the ends thereof are characterized by:

two additional CMD yarns interwoven with the MD yarn system in each seam zone in a repeat pattern in which one of the additional yarns weaves over and under the adjacent pairs of the upper and lower MD yarns and the other additional yarn weaves under and over the adjacent pairs of the repeat to place the seam loops in substantially vertical and horizontal alignment.

2. The fabric according to claim 1 wherein the MD yarn system comprises weft yarns and the CMD yarn system comprises warp yarns.

3. The fabric according to claim 1 wherein batt material is attached to the fabric.

4. The fabric according to claim 1 wherein the additional yarns are multifilament yarns.

5. An open ended papermaker's fabric of a type having a MD yarn system, including adjacent pairs of upper and lower MD yarns, interwoven with a CMD yarn system wherein a plurality of seam loops are formed at each end of the fabric by yarns from the MD yarn system and a seam zone is defined at each end of the fabric between the respective seam loops and a respective last CMD yarn, the ends thereof are characterized by:

two additional CMD yarns interwoven with the MD yarn system in each seam zone in a repeat pattern in which one of the additional yarns weaves over, between, under and between the adjacent pairs of the upper and lower MD yarns of the repeat and the other additional yarn weaves under, between, over and between the adjacent pairs of the repeat to place the seam loops in substantially vertical and horizontal alignment.

6. The fabric according to claim 5 wherein the MD yarn system comprises weft yarns and the CMD yarn system comprises warp yarns.

7. The fabric according to claim 5 wherein batt material is attached to the fabric.

8. The fabric according to claim 5 wherein the additional yarns are multifilament yarns.

* * * * *